US008061680B1

(12) United States Patent
Erickson

(10) Patent No.: US 8,061,680 B1
(45) Date of Patent: Nov. 22, 2011

(54) INTER-TRUSS FRAME FOR SUPPORTING CONCRETE FORMWORK

(76) Inventor: Brian C. Erickson, Stockton, CA (US)

( * ) Notice: Subject to any disclaimer, the term of this patent is extended or adjusted under 35 U.S.C. 154(b) by 1064 days.

(21) Appl. No.: 11/557,230

(22) Filed: Nov. 7, 2006

(51) Int. Cl.
*E04G 17/06* (2006.01)
*E04G 11/06* (2006.01)

(52) U.S. Cl. ..... 249/34; 249/210; 249/216

(58) Field of Classification Search ..... 249/2, 3, 249/4, 5, 6, 7, 8, 34, 207, 208, 209, 210, 249/212, 213, 216; 269/37, 43
See application file for complete search history.

(56) References Cited

U.S. PATENT DOCUMENTS

| | | | | | |
|---|---|---|---|---|---|
| 857,524 | A | * | 6/1907 | Hindman et al. | 249/210 |
| 1,013,711 | A | * | 1/1912 | Wiggins | 269/45 |
| 1,128,809 | A | * | 2/1915 | Markham | 249/210 |
| 1,211,812 | A | * | 1/1917 | Barnes | 249/210 |
| 1,972,913 | A | | 9/1934 | Anderson | |
| 2,045,307 | A | * | 6/1936 | O'Connell | 269/43 |
| 2,446,255 | A | * | 8/1948 | Vocisano | 249/210 |
| 2,510,767 | A | * | 6/1950 | Vocisano | 249/210 |
| 2,635,320 | A | | 4/1953 | Ornitz | |
| 2,669,958 | A | * | 2/1954 | Sweeney | 269/45 |
| 2,803,872 | A | * | 8/1957 | Massa | 269/37 |
| 2,827,690 | A | * | 3/1958 | Brown | 269/17 |
| 3,288,042 | A | | 11/1966 | Gaetke | |
| 3,785,606 | A | | 1/1974 | Green | |
| 3,963,210 | A | | 6/1976 | Macklin | |
| 4,498,807 | A | | 2/1985 | Kirkpatrick et al. | |
| 4,817,353 | A | | 4/1989 | Woods et al. | |
| 5,174,083 | A | | 12/1992 | Mussell | |
| 5,399,050 | A | | 3/1995 | Jacobus | |
| 5,419,055 | A | | 5/1995 | Meadows | |
| 5,830,378 | A | | 11/1998 | Butler | |
| 5,863,034 | A | * | 1/1999 | Vauter | 269/51 |
| 6,024,348 | A | * | 2/2000 | Ventura et al. | 269/17 |
| 6,231,025 | B1 | | 5/2001 | Takemura | |
| 6,367,764 | B1 | | 4/2002 | Butler | |
| 6,397,535 | B1 | | 6/2002 | Kim et al. | |
| 6,837,934 | B1 | * | 1/2005 | Patrykus | 118/500 |
| 7,357,399 | B1 | * | 4/2008 | Klotz | 280/79.11 |
| 7,445,184 | B1 | * | 11/2008 | Johnson | 269/45 |

* cited by examiner

*Primary Examiner* — Michael Safavi
(74) *Attorney, Agent, or Firm* — Charles L. Thoeming

(57) ABSTRACT

Disclosed are a height-adjustable inter-form concrete mold supporting system and method for in situ concrete construction. The system has a support member detachably disposed on a base plate. An inter-form truss is adjustably attached to the support member and holds formwork brackets to define concrete pour width. A plurality of like assemblages and attached formwork define concrete pour length and height of the monolithic concrete slab-on-grade foundations or flooring in situ.

7 Claims, 8 Drawing Sheets

INTER-TRUSS FRAME FOR SUPPORTING CONCRETE FORMWORK

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

The present invention relates generally to an inter-form concrete mold supporting system and method for constructing concrete foundations or floors through the use of the inter-form system, and more particularly to a height-adjustable, inter-truss as a featured component of the inter-form system and a method for easily constructing monolithic concrete slab-on-grade floors and foundations in situ with enhanced cost-effectiveness.

2. Description of the Related Art

A search of the prior art located the following United States patents which are believed to be representative of the present state of the prior art: U.S. Pat. No. 6,397,535 B1, issued June 2002, U.S. Pat. No. 6,367,764 B1, issued April 2002, U.S. Pat. No. 5,830,378 issued November 1998, U.S. Pat. No. 6,231,025 B1, issued May 2001, U.S. Pat. No. 5,419,055, issued May 1995, U.S. Pat. No. 5,174,083, issued December 1992, U.S. Pat. No. 4,817,353, issued April 1989, U.S. Pat. No. 5,399,050, issued March 1995, U.S. Pat. No. 1,972,913 issued September 1934, U.S. Pat. No. 4,498,707, issued February 1985, U.S. Pat. No. 3,963,210, issued June 1976, U.S. Pat. No. 3,785,606 issued January 1974, U.S. Pat. No. 3,288,042, issued November 1966, and U.S. Pat. No. 2,635,320, issued April 1953.

BRIEF SUMMARY OF THE INVENTION

The inter-form system and method provide the use of an inter-truss form to eliminate formwork members cast in concrete foundations. The inter-form system and method also eliminate steel or wood stake voids and possible corrosion to structural concrete reinforcements from intrusion of moisture from earthen substrate.

It is therefore an object of the inter-form system and method to provide an easily configured and adjustable concrete mold supporting system and method for constructing concrete floors and foundations.

Specifically, it is an object of the inter-form system and method to provide a novel system and method for cost effective concrete floor and foundation construction by use of low cost components and elimination of labor costs as well as the costs associated with traditional forming brackets which require storage, transportation and maintenance.

Another object of the inter-form system and method is to provide a system to eliminate formwork members cast in concrete foundations.

It is also an object of the inter-form system and method to provide a novel system which eliminates steel or wood stake voids and further eliminates early corrosion to structural concrete re-enforcement is due to earth moisture intrusion.

A preferred embodiment of the inter-form system and method discloses a combination of four central components. A steel base plate coated in plastic to prevent the steel having contact with the earth receives a piece of Rebar which is set into vertical position by the base plate sleeve. The Rebar held by the base plate acts as the support member or leg of the system. The length of the support member or leg is determined by depth of footing and is field cut. The central piece of the system, the inter-truss is positioned over the top of the support member and is set to elevation with a set nut. It is then determined where the holes are to be drilled in the form boards. After determining the hole locations, a piece of half-inch, inner rod having threaded ends is sized between forms and inserted into the truss. Angle brackets are installed to the truss using threaded taper bolts threaded on to the inner rod threaded ends. The angle bracket is installed above top of the form and lumber is nailed in to hold the top of the form to the desired width and above to allow finishing under support. The dimension between each of these members is determined by height and width of designed form. The final step is to align all set and placed forms with wood or steel stakes secured into the earth outside the foundation limits.

In an embodiment of the inter-form system and method under light forming conditions the inner rod, taper bolts, and angle brackets can be replaced by a special made snap tie and wedge to hold form boards on each side.

Other features, advantages, and objects of the inter-form system and method will become apparent with reference to the following description read in conjunction with the accompanying drawings.

DETAILED DESCRIPTION OF THE INVENTION

Figure 1:
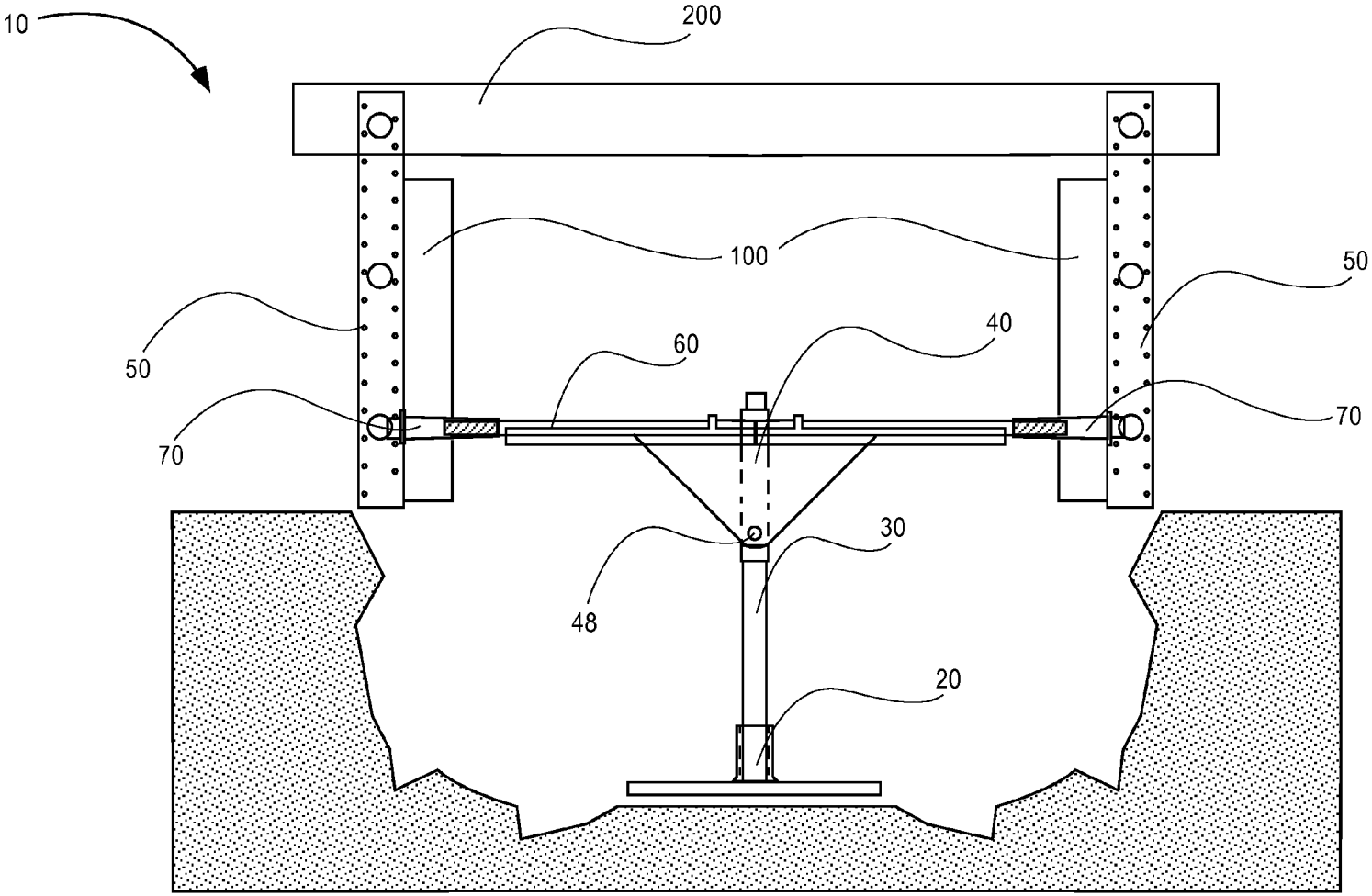
FIG. 1 is a front elevation view of an embodiment of the inter-form concrete mold supporting system.
Figure 2:
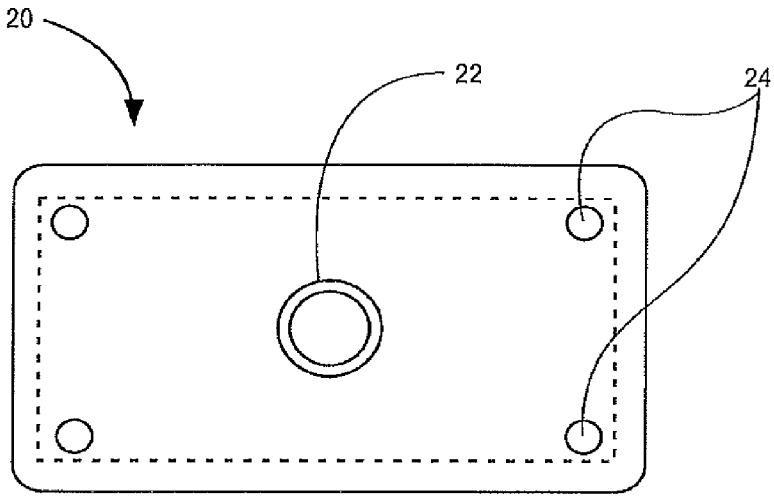
FIG. 2 is a top planar view of the base plate element of FIG. 1.
Figure 2A:
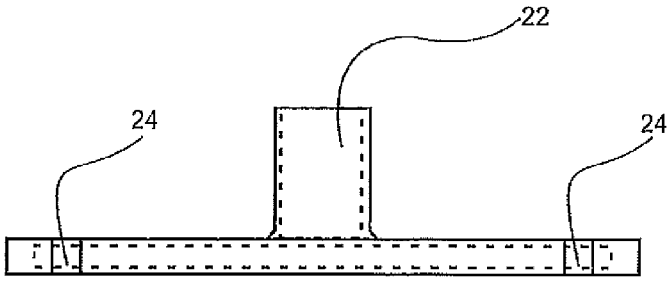
FIG. 2A is a front elevation view of FIG. 2.

Referring to the drawing figures, an embodiment of the inter-form concrete framing system includes: a base plate 20; a support member 30 having a top end and a bottom end, wherein the support member 30 bottom end is supported in a vertical position by the base plate 20; an inter-truss member 40 having a predetermined length and two ends, the inter-truss member 40 positioned perpendicular to the support member 30 and adjustably attached to the support member 30 top end; and an attachment assembly on each truss member end whereby vertical angle brackets 50 are fixedly attached perpendicularly to the second tubing member 46 of the inter-truss member 40.

Figure 3B:
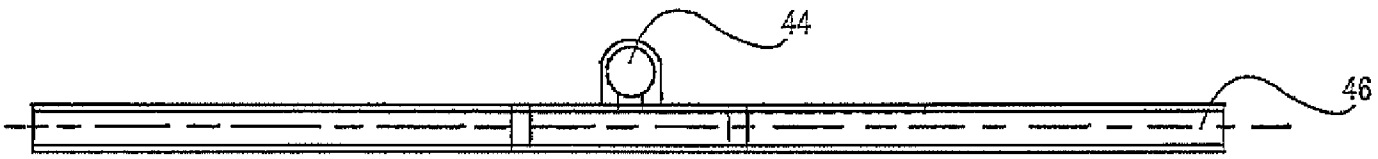
FIG. 3B is a top planar view of FIG. 3.
Figure 3:
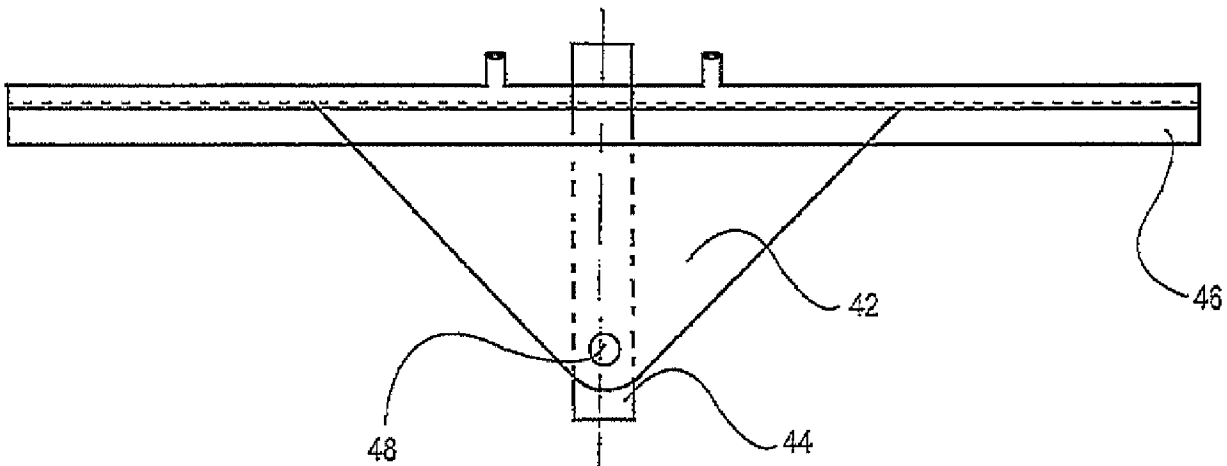
FIG. 3 is a front elevation view of the inter-truss element of FIG. 1.

The inter-truss member 40 further comprises a stabilization member 42 connected to first 44 and second 46 tubing members of predetermined length, FIGS. 3-3B. Each tubing member 44 and 46 comprises two ends and an exterior side. The first tubing member 44 is sized to receive and secure the support member 30 top end to define top and bottom first tubing member 44 ends. The first 44 and second 46 tubing members are fixedly attached to the stabilization member 42 such that the top end of the first tubing member 44 is transverse to the second tubing member 46.

In an embodiment of the present invention, the inter-truss member 40 further comprises an inner rod 60 sized to reside within and extend beyond the second tubing 46 length. This inner rod 60 comprises two threaded ends to receive a threaded attachment assembly.

In an embodiment of the present invention, the base plate 20 comprises a centered sleeve 22 having a centered opening of predetermined diameter extending vertically from the plate and sized to receive and hold the vertical member 30. The base plate 20 comprises steel coated with plastic. The base plate further comprises at least four openings 24 to secure the plate to a ground substrate.

The attachment assembly of an embodiment of the present invention comprises two threaded taper bolts 70 each sized to fit and attach over the inter-truss 40 inner rod 60 threaded end thus securing an angle bracket 50.

The attachment assembly of an alternate embodiment of the present invention comprises snap tie 80 and wedge 90 assembly wherein the snap tie 80 is sized to be fixedly inserted through at least one wedge 90 and into each second tubing member 46 end thus securing formwork 100.

Figure 3A:
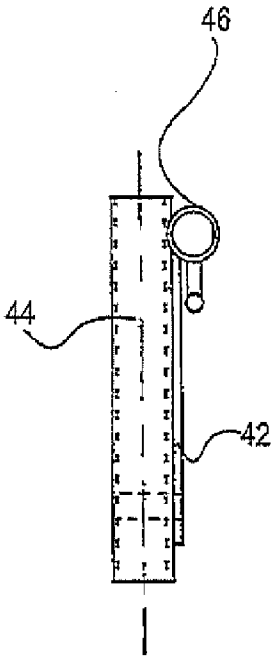
FIG. 3A is a left side view of FIG. 3.

The preferred embodiment 10 of inter-form concrete framing system, FIGS. 1-5, comprises a steel base plate base 20 coated with plastic comprising at least four openings 24 to secure the base plate 20 to a ground substrate and further comprising a center sleeve 22 having a centered opening of predetermined diameter extending vertically from the plate sized to receive and hold a support member 30. The preferred embodiment 10 support member 30 is a predetermined length of Rebar having a top end and a bottom end. The rebar bottom end is insertably attached into to the base plate sleeve 22, whereby the rebar support member 30 is held in a fixed vertical position. The preferred embodiment 10 of the present invention further comprises an inter-truss member 40 comprising a stabilization member 42 and first 44 and second 46 tubing members of predetermined length. Each tubing member 44 and 46 comprises two ends and exterior sides, FIGS. 3, 3A and 3B. The inter-truss member 40 further comprises a rod 60 sized to reside within and extend beyond the second tubing member 46. The rod 60 comprises two threaded ends. The first tubing member 44 is sized to receive and secure the support member 30 top end and thereby define top and bottom first tubing member 44 ends. The tubing members 44 and 46 are fixedly attached in transverse alignment with the stabilization member 42 such that the top end of the first tubing member 44 is in tangential communication with the transverse second tubing member 46. Threaded taper bolts 70 sized to fit and attach each rod 60 threaded end to an angle bracket 50 whereby vertical angle brackets 50 are fixedly attached perpendicularly to the inter-truss second tubing member 46.

The foregoing assembly and inter-form system can be used for ready-mixed concrete inter-form method characterized by the following steps: 1) arranging, at a predetermined interval, at least two inter-form systems 10 or 12 according to the foregoing specification (i.e., FIGS. 1 and 6); 2) setting the elevation of each inter-truss member 40 on its corresponding vertical support member 30; 3) mounting opposed formworks 100 on the vertical angle brackets 50 so as to locate the inter-form system in a space formed between opposed formwork 100 and define an upper end surface; 4) mounting formwork 200 to opposed formwork 100 upper ends; 5) aligning all set and placed formwork with staking secured into the ground substrate beyond the foundation limits (not depicted); 6) filling ready mix concrete in the space provided between opposed formwork 100 up to top formwork 200; 7) allowing the concrete to cure; and 8) removing formwork 100 and 200. When the concrete has been applied to the space defined within formwork 100 and 200, the inventive inter-form system is buried into the concrete floor or foundation with only the upper surface of formwork 200 and the exterior surfaces of formwork 100 exposed to the outside.

Figure 4:
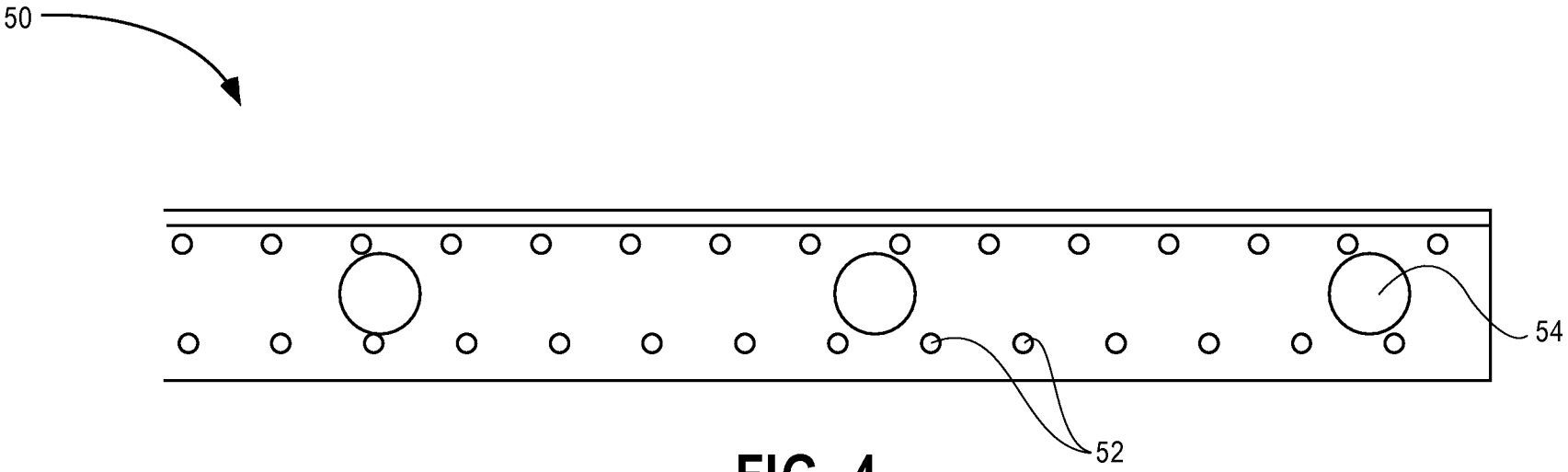
FIG. 4 is a side view of the angle bracket element of FIG. 1.
Figure 5:
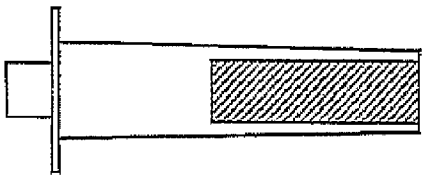
FIG. 5 is a side view of the taper bold element of FIG. 1.
Figure 5A:
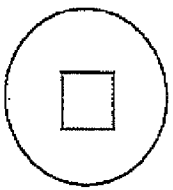
FIG. 5A is an end view of FIG. 5.

Support member 30 is determined by depth of footing and is field cut. After the inter-truss 40 is positioned over the top of the support member 30, the inter-truss 40 is set to elevation with on the support member 30 by a set nut 48 through the first tubing member 44 and locking against the support member 30, FIG. 3. At this point, it is then determined where the holes are to be drilled in the formwork 100. After determining formwork 100 hole locations, a piece of one-half inch end-threaded or all-thread inner rod 60 that is cut or purchased to proper length, preferably to a length two inches less than formwork width and centered between the formwork 100. Next, angle brackets 50, FIGS. 1 and 4, typically comprising a piece of two inch angle with pre-drilled large holes 54 for each taper bolt 60 and smaller holes 52 for #8 or #16 duplex nails, FIG. 4, are installed. Each angle bracket 50 is held in place and each taper bolt 60, FIGS. 1 and 5, is slid through a corresponding angle bracket 50 large hole 54 and formwork 100 and threaded on to the threaded ends of inner rod 60. The angle bracket 50 is installed above formwork 100 and additional formwork 200 is nailed in to hold formwork to the desired width to allow finishing under support. The dimension between each of these members is determined by height and width of the desired form. All set and placed formwork is aligned and set with wood or steel stakes secured into the earth substrate outside foundation limits (not depicted).

Figure 6:
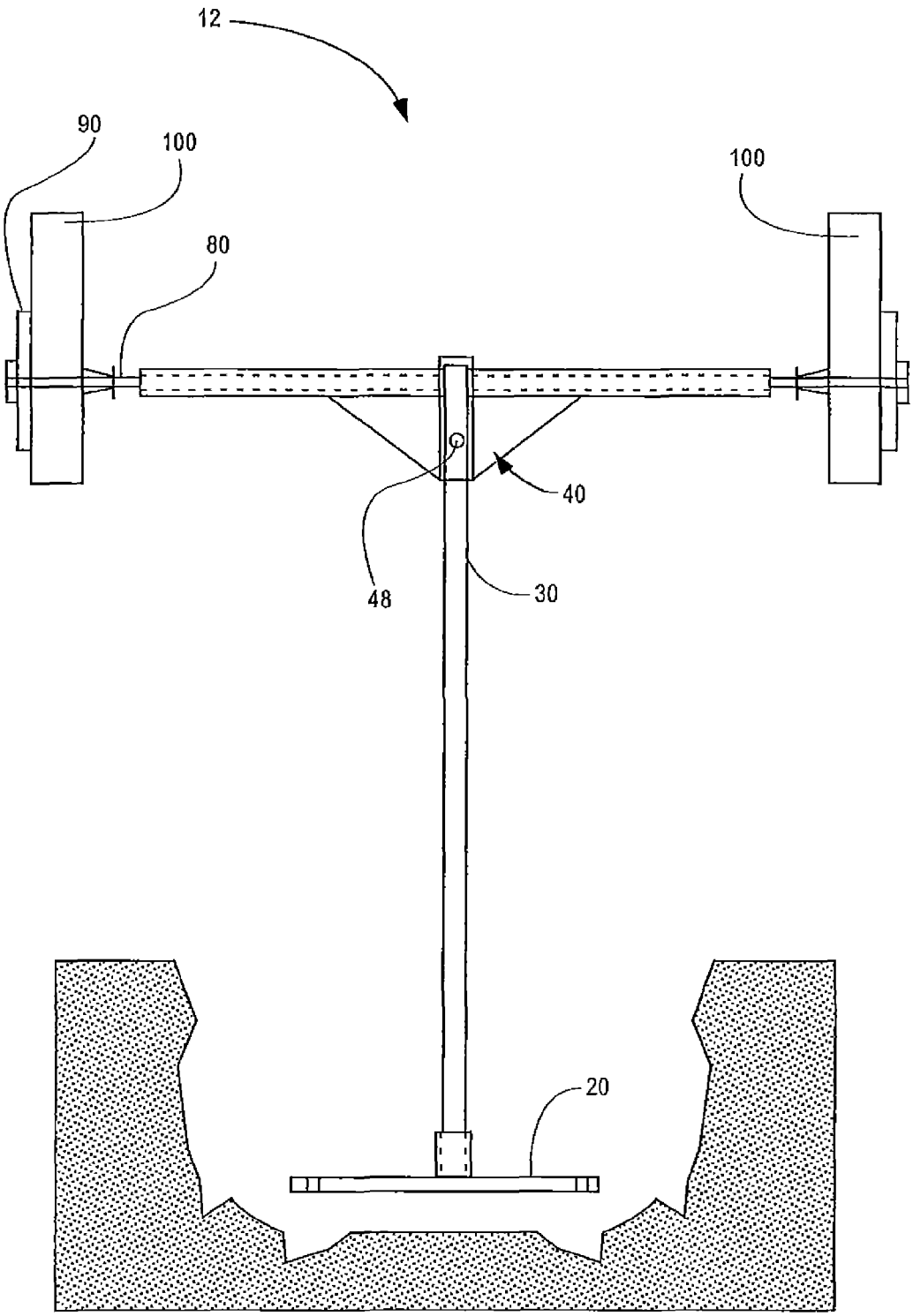
FIG. 6 is a elevation end view of an embodiment of the present invention for inter-form concrete mold supporting system.
Figure 7:
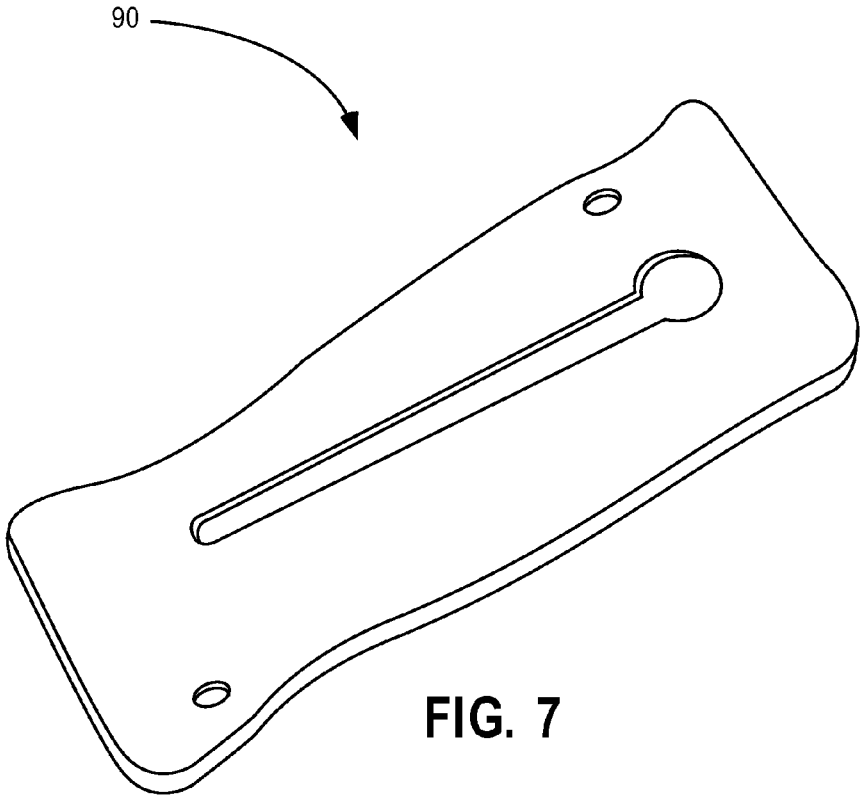
FIG. 7 is a perspective view of the wedge element of FIG. 6.
Figure 8:
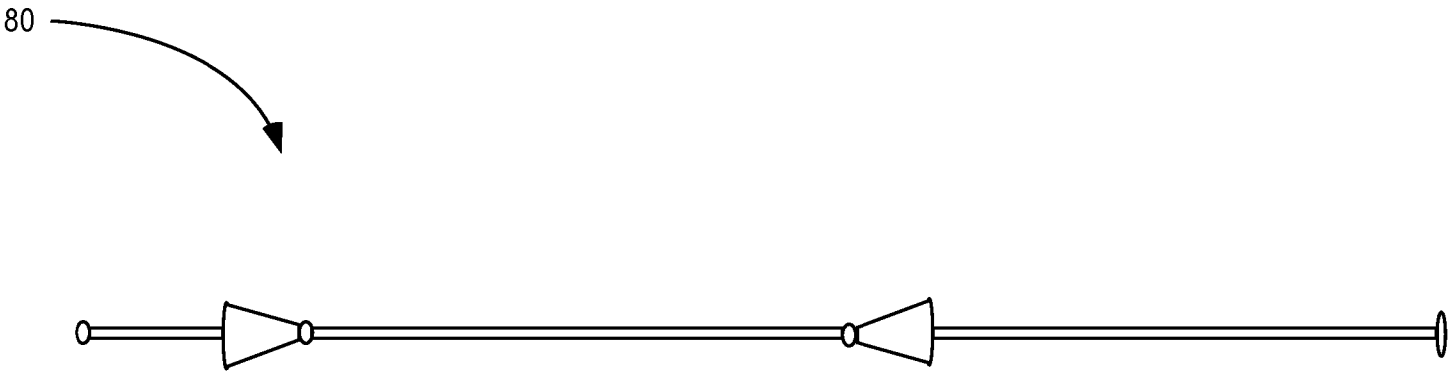
FIG. 8 is a side elevation view of the snap-tie element of FIG. 6.

In an embodiment of the invention 12 under light forming conditions the inner rod 60, taper bolts 70 and angle bracket 50 can be replaced by a special made snap tie 80 and wedge 90 to hold the formwork 100 to the inter-truss 40, FIGS. 6-8.

In accordance with the preceding explanation, variations and adaptations of the inter-form concrete mold supporting system and method invention will suggest themselves to a practitioner of the construction equipment arts. Thus, in accordance with these and other possible variations and adaptations of the present invention, the scope of the invention should be determined in accordance with the following claims, only, and not solely in accordance with that embodiment within which the invention has been taught.

I claim:

1. An inter-form concrete framing system comprising, in combination, a) an inter-truss member comprising: a first tube comprising a longitudinal axis defining a length and comprising two open ends, an internal surface, an external surface, and a circular, threaded opening through the external surface and the internal surface; a second tube comprising a longitudinal axis defining a length and comprising two open ends, an internal surface, and an external surface; a triangular plate defining a uniform thickness and comprising a base, an apex, a front surface, a back surface, a central axis between the triangular plate base and apex, and a circular, threaded opening having a diameter equal to the first tube circular, threaded opening, extending through the uniform thickness at a location centered on the triangular plate central axis near the apex;

wherein the first tube external surface is attached to the triangular plate back surface along the triangular plate central axis such that the triangular plate base can be positioned above the triangular plate apex when the first tube longitudinal axis is positioned parallel to the triangular plate central axis, and wherein the first tube circular, threaded opening is aligned with the triangular plate circular, threaded opening; wherein the second tube external surface is attached to the triangular plate base and the first tube external surface such that the second tube longitudinal axis is transverse to the triangular plate central axis;

b) a vertical support element comprising a top end and a bottom end, and a uniform diameter sized to be received into the first tube along first tube longitudinal axis;

c) a base plate sized to receive and fixedly hold the vertical support element bottom end;

d) means for attaching vertical angle brackets to each second tube open end; and e) threaded locking means sized to be received through the aligned first tube circular threaded opening and triangular plate circular threaded opening for adjustably positioning and attaching the inter-truss member to the vertical support element;

whereby at least two inter-truss members and associated vertical support element, base plate, means for attaching vertical angle brackets to each second tube open end, and threaded locking means sized to be received through the aligned first tube circular threaded opening and triangular plate circular threaded opening for adjustably positioning and attaching the inter-truss member to the vertical support element for each such inter-truss member can be arranged at a predetermined interval above an earthen substrate, vertical angel brackets, mounting and opposed framework can be attached to each inter-truss thus defining a space, and concrete can be filled into the defined space within the vertical angel brackets, substrate and formwork, thus eliminating voids and possible corrosion to structural concrete reinforcements from intrusion of moisture from the substrate.

2. The inter-form concrete framing system of claim 1, wherein the means for attaching vertical angle brackets to each second tube open end comprises an inner rod sized to reside within the second tube and extend beyond the second tube length, the inner rod comprising two threaded ends to receive attachment means on each inner rod end for fixedly attaching vertical angle brackets perpendicular to the second tube longitudinal axis.

3. The inter-form concrete framing system of claim 1, wherein the base plate comprises a centered sleeve having a central opening sized to receive and fixedly hold the vertical support element in a substantially vertical position relative to the base plate.

4. The inter-form concrete framing system of claim 3, wherein the base plate further comprises steel coated with plastic.

5. The inter-form concrete framing system of claim 4, wherein the base plate further comprises at least four openings sized to receive means for securing the base plate to the earthen substrate.

6. The inter-form concrete framing system of claim 2, wherein the attachment means on each inner rod end for fixedly attaching vertical angle brackets perpendicular to the second tube longitudinal axis comprises two threaded taper bolts each sized to fit and attach over an inter-truss inner rod threaded end to secure the angle bracket.

7. An inter-form concrete framing system comprising, in combination, a) an inter-truss member comprising: a first tube comprising a longitudinal axis defining a length and comprising two open ends, an internal surface, an external surface, and a circular, threaded opening through the external surface and the internal surface; a second tube comprising a longitudinal axis defining a length and comprising two open ends, an internal surface, and an external surface; a triangular plate defining a uniform thickness and comprising a base, an apex, a front surface, a back surface, a central axis between the triangular plate base and apex, and a circular, threaded opening having a diameter equal to the first tube circular, threaded opening, extending through the uniform thickness at a location centered on the triangular plate central axis near the apex; wherein the first tube external surface is attached to the triangular plate back surface along the triangular plate central axis such that the triangular plate base can be positioned above the triangular plate apex when the first tube longitudinal axis is positioned parallel to the triangular plate central axis, and wherein the first tube circular, threaded opening is aligned with the triangular plate circular, threaded opening; wherein the second tube external surface is attached to the triangular plate base and the first tube external surface such that the second tube longitudinal axis is transverse to the triangular plate central axis and the first tube longitudinal axis;

b) a vertical support element comprising a top end and a bottom end, and a uniform diameter sized to be received into the first tube along first tube longitudinal axis;

c) a base plate comprising a centered sleeve having a central opening sized to receive and fixedly hold the vertical support element in a substantially vertical position relative to the base plate, the base plate sized to receive and fixedly hold the vertical support element bottom end, and further comprising steel coated with plastic and at least four openings sized to receive means for securing the base plate to an earthen substrate;

d) an inner rod sized to reside within the second tube and extend beyond the second tube length, the inner rod comprising two threaded ends to receive two threaded taper bolts each sized to fit and attach over an inter-truss inner rod threaded end to secure an angle bracket perpendicular to the second tube longitudinal axis; and e) a set nut sized to be received through the aligned first tube circular threaded opening and triangular plate circular threaded opening for adjustably positioning and attaching the inter-truss member to the vertical support element;

whereby at least two inter-truss members and associated vertical support element, base plate, means for attaching vertical angle brackets to each second tube open end, and set nut for each such inter-truss member can be arranged at a predetermined interval above the earthen substrate, vertical angle brackets, mounting and opposed framework can be attached to each inter-truss thus defining a space, and concrete can be filled into the defined space within the vertical angel brackets, substrate and formwork, thus eliminating voids and possible corrosion to structural concrete reinforcements from intrusion of moisture from the substrate.

* * * * *